US009289056B2

(12) United States Patent
Castaneda

(10) Patent No.: US 9,289,056 B2
(45) Date of Patent: Mar. 22, 2016

(54) COVERABLE TOOTHBRUSH ASSEMBLY

(71) Applicant: Danny Castaneda, Cedar Hill, TX (US)

(72) Inventor: Danny Castaneda, Cedar Hill, TX (US)

( * ) Notice: Subject to any disclaimer, the term of this patent is extended or adjusted under 35 U.S.C. 154(b) by 0 days.

(21) Appl. No.: 14/317,688

(22) Filed: Jun. 27, 2014

(65) Prior Publication Data

US 2015/0374112 A1 Dec. 31, 2015

(51) Int. Cl.
*A46B 17/04* (2006.01)
*A46B 9/04* (2006.01)

(52) U.S. Cl.
CPC .. *A46B 17/04* (2013.01); *A46B 9/04* (2013.01)

(58) Field of Classification Search
CPC ..... A46B 17/04
USPC ..... 15/184; 132/308; 206/361, 362.3; D4/104, 108, 113
See application file for complete search history.

(56) References Cited

U.S. PATENT DOCUMENTS

| | | | | |
|---|---|---|---|---|
| 1,653,540 | A | 12/1927 | Bigoney | |
| 2,774,982 | A * | 12/1956 | Reed | 15/184 |
| 4,835,813 | A | 6/1989 | Lorenzana et al. | |
| D304,786 | S * | 11/1989 | Kayamura | D4/104 |
| 5,044,039 | A | 9/1991 | Picard | |
| 5,048,144 | A * | 9/1991 | Andrews | 15/184 |
| 5,771,521 | A | 6/1998 | McNamee | |
| 5,779,046 | A | 7/1998 | Piakos | |
| 5,924,567 | A | 7/1999 | Wenum | |
| D670,506 | S | 11/2012 | Kayser | |
| 2004/0170464 | A1 * | 9/2004 | Polczynski | 401/123 |
| 2006/0059643 | A1 | 3/2006 | Jimenez | |
| 2009/0288972 | A1 | 11/2009 | Kayser | |

FOREIGN PATENT DOCUMENTS

| | | | |
|---|---|---|---|
| CH | 101356 | * | 9/1923 |
| FR | 1516249 | * | 3/1968 |

* cited by examiner

*Primary Examiner* — Mark Spisich

(57) ABSTRACT

A coverable toothbrush assembly protects bristles of a toothbrush from dirt, germs and the like. The assembly includes a toothbrush having a handle, a head and a neck. The neck is coupled to and extends between the head and the handle. A platform is coupled to the head. A plurality of bristles is coupled to and extends upwardly from the platform. A peripheral edge of the platform is spaced from a perimeter edge of the head. A cap is removably coupled to the toothbrush. The cap has a top and a perimeter wall coupled to and extending downwardly from the top. A bottom edge of the perimeter wall defines an access opening into an interior space of the cap. The perimeter wall engages the platform to couple the cap to the toothbrush. The bristles are positioned in the interior space when the cap is coupled to the toothbrush.

11 Claims, 3 Drawing Sheets

COVERABLE TOOTHBRUSH ASSEMBLY

BACKGROUND OF THE DISCLOSURE

Field of the Disclosure

The disclosure relates to toothbrush devices and more particularly pertains to a new toothbrush device for protecting bristles of a toothbrush from dirt, germs and the like when the toothbrush is not in use.

SUMMARY OF THE DISCLOSURE

An embodiment of the disclosure meets the needs presented above by generally comprising a toothbrush having a handle, a head and a neck. The neck is coupled to and extends between the head and the handle. A platform is coupled to the head. A plurality of bristles is coupled to and extends upwardly from the platform. A peripheral edge of the platform is spaced from a perimeter edge of the head. A cap is removably coupled to the toothbrush. The cap has a top and a perimeter wall coupled to and extending downwardly from the top. A bottom edge of the perimeter wall defines an access opening into an interior space of the cap. The perimeter wall engages the platform to couple the cap to the toothbrush. The bristles are positioned in the interior space when the cap is coupled to the toothbrush.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
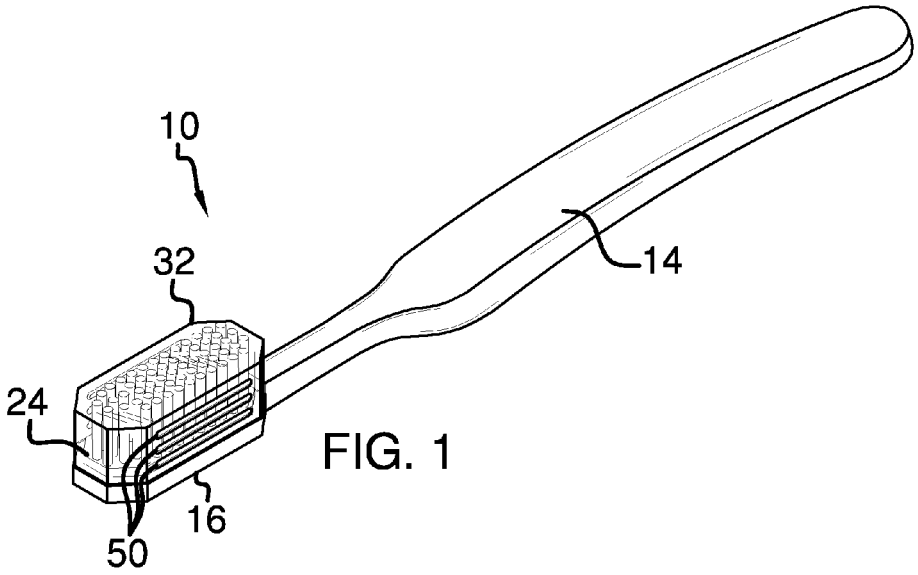
FIG. 1 is a top front side perspective view of a coverable toothbrush assembly according to an embodiment of the disclosure.
Figure 2:
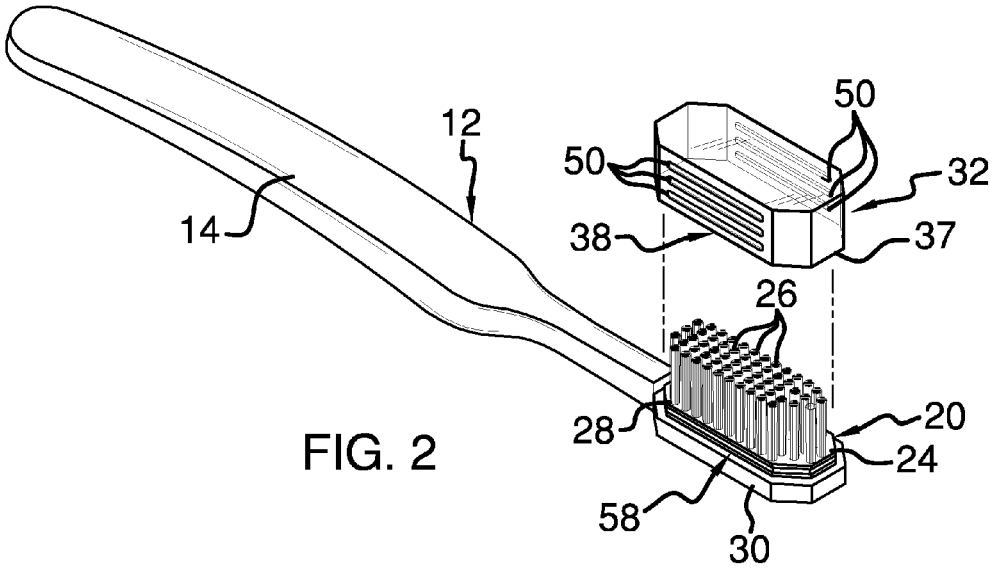
FIG. 2 is an exploded top front side perspective view of an embodiment of the disclosure.
Figure 3:
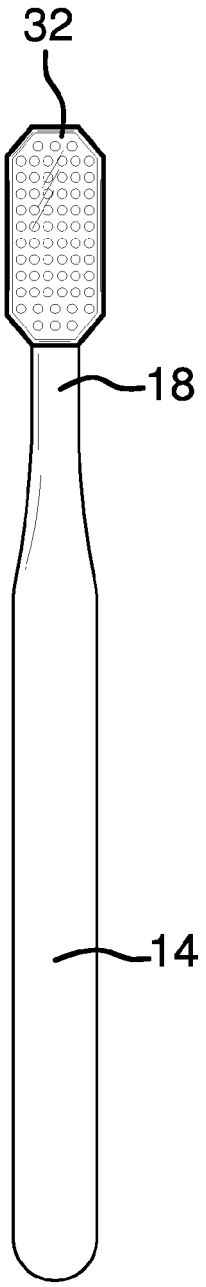
FIG. 3 is a top view of an embodiment of the disclosure.
Figure 4:
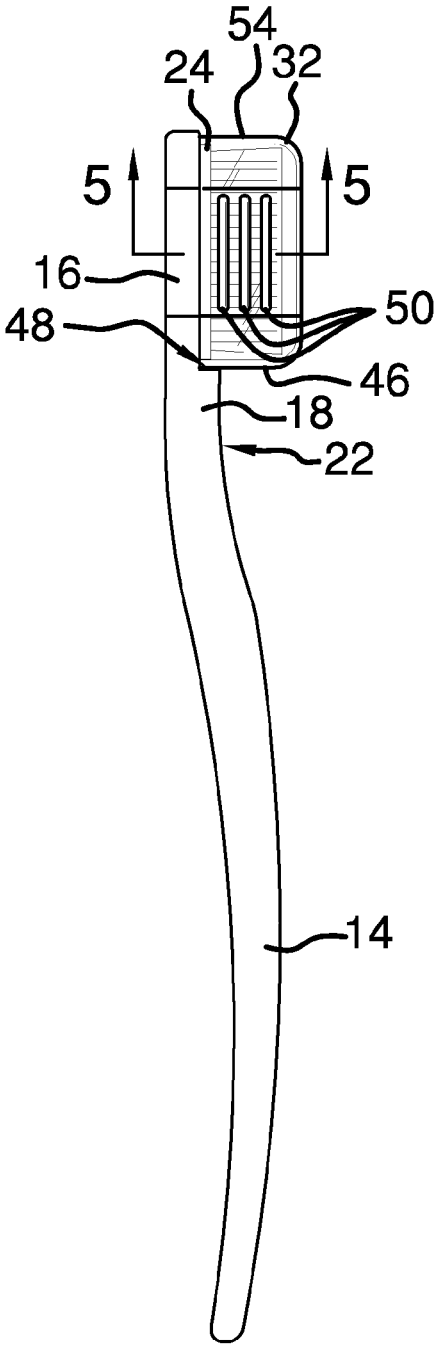
FIG. 4 is a side view of an embodiment of the disclosure.
Figure 5:
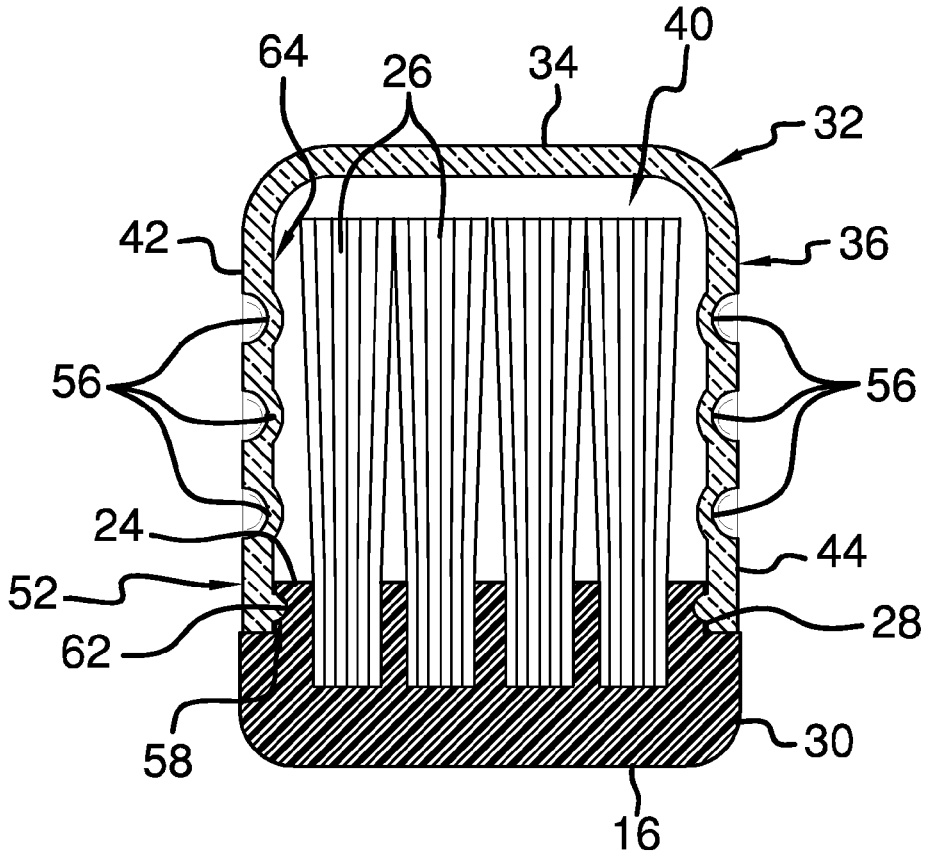
FIG. 5 is a cross-sectional view of an embodiment of the disclosure taken along line 5-5 of FIG. 4.

With reference now to the drawings, and in particular to FIGS. 1 through 5 thereof, a new toothbrush device embodying the principles and concepts of an embodiment of the disclosure and generally designated by the reference numeral 10 will be described.

As best illustrated in FIGS. 1 through 5, the coverable toothbrush assembly 10 generally comprises a toothbrush 12 having a handle 14, a head 16 and a neck 18. The neck 18 is coupled to and extends between the head 16 and the handle 14. The head 16 has a top side 20 that may be positioned in spaced relationship below an upper surface 22 of the neck 18. A platform 24 is coupled to the top side 20 of the head 16 and may be integrally coupled to the head 16. A plurality of bristles 26 is coupled to and extends upwardly from the platform 24. A peripheral edge 28 of the platform 24 is spaced from a perimeter edge 30 of the head 16.

A cap 32 is removably coupled to the toothbrush 12. The cap 32 has a top 34 and a perimeter wall 36 coupled to and extending downwardly from the top 34. A bottom edge 37 of the perimeter wall 36 defines an access opening 38 into an interior space 40 of the cap 32. The perimeter wall 36 of the cap 32 may have an octagonal shape including a first longitudinal side 42 and a second longitudinal side 44 positioned opposite of each other. A rear end 46 of the cap 32 may abut a front edge 48 of the neck 18 when the cap 32 is coupled to the platform 24. The perimeter wall 36 of the cap 32 engages the platform 24 to couple the cap 32 to the toothbrush 12. The bristles 26 are positioned in the interior space 40 of the cap 32 when the cap 32 is coupled to the toothbrush 12. The cap 32 may be transparent. The cap 32 may have a height extending from the bottom edge 37 to the top 34 measuring between approximately 2.0 cm and 3.0 cm. The cap 32 may have a width extending between the first 42 and second 44 longitudinal sides measuring between approximately 1.2 cm and 1.8 cm. The cap 32 may have a length extending from the rear end 46 to a front end 54 of the cap 32 measuring between approximately 2.8 cm and 4.0 cm.

The perimeter wall 36 of the cap 32 has a plurality of indentations 50 extending into an outer surface 52 thereof to facilitate gripping and lifting of the cap 32. Each of the indentations 50 may be elongated extending along the first 42 and second 44 longitudinal sides. The indentations 50 on the first longitudinal side 42 are spaced and aligned relative to each other. Similarly, the indentations 50 on the second longitudinal side 44 are spaced and aligned relative to each other. Each of the indentations 50 may extend longitudinally between the front end 54 and the rear end 46 of the cap 32. Each of the indentations 50 may define a concave depression 56 in the outer surface 52 of the perimeter wall 36.

A groove 58 extends into the peripheral edge 28 of the platform 24 and extends around a full perimeter of the peripheral edge 28. A projection 62 is coupled to an inner surface 64 of the cap 32 extending into the interior space 40. The projection 62 extends around a full perimeter of the perimeter wall 36. The projection 62 is received in the groove 58 for securing the cap 32 to the platform 24. The projection 62 is spaced above the bottom edge 37 of the cap 32.

In use, the cap 32 is coupled to the platform 24 by inserting the projection 62 of the cap 32 into the groove 58. When the cap 32 is coupled to the platform 24, the cap 32 extends around the bristles 26 to protect the bristles 26 from coming into contact with dirt, germs and the like while the toothbrush 12 is not being used. The indentations 50 facilitate lifting the cap 32 off the platform 24 when use of the toothbrush 12 is desired.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A coverable toothbrush assembly comprising:

a toothbrush having a handle, a head and a neck, said neck being coupled to and extending between said head and said handle, said head having a top side;

a platform coupled to said top side of said head, a plurality of bristles being coupled to and extending upwardly from said platform, a peripheral edge of said platform being spaced from a perimeter edge of said head; and a cap removably coupled to said toothbrush, said cap having a top and a perimeter wall coupled to and extending downwardly from said top, a bottom edge of said perimeter wall defining an access opening into an interior space of said cap, said perimeter wall of said cap engaging said platform to couple said cap to said toothbrush, said bristles being positioned in said interior space of said cap when said cap is coupled to said toothbrush, said top side of said head being positioned in spaced relationship below an upper surface of said neck, a rear end of said cap abutting a front edge of said neck when said cap is coupled to said platform.

2. The assembly of claim 1, further comprising wherein said perimeter wall of said cap has an octagonal shape.

3. The assembly of claim 1, further comprising wherein said cap is transparent.

4. The assembly of claim 1, further comprising said perimeter wall of said cap having a plurality of indentations extending into an outer surface thereof to facilitate gripping of said cap.

5. The assembly of claim 4, further comprising said perimeter wall including a first longitudinal side and a second longitudinal side positioned opposite of each other, each of said indentations being elongated extending along said first and second longitudinal sides, said indentations on said first longitudinal side being spaced and aligned relative to each other, said indentations on said second longitudinal side being spaced and aligned relative to each other.

6. The assembly of claim 5, further comprising each of said indentations extending longitudinally between a front end and said rear end of said cap.

7. The assembly of claim 4, further comprising each of said indentations defining a concave depression in said outer surface of said perimeter wall.

8. The assembly of claim 1, further comprising said platform being integrally coupled to said head.

9. The assembly of claim 1, further comprising:

a groove extending into said peripheral edge of said platform, said groove extending around a full perimeter of said peripheral edge; and a projection coupled to an inner surface of said cap extending into said interior space, said projection extending around a full perimeter of said perimeter wall, said projection being received in said groove for securing said cap to said platform.

10. The assembly of claim 9, further comprising wherein said projection is spaced above said bottom edge of said cap.

11. A coverable toothbrush assembly comprising:

a toothbrush having a handle, a head and a neck, said neck being coupled to and extending between said head and said handle, said head having a top side, said top side of said head being positioned in spaced relationship below an upper surface of said neck;

a platform coupled to said top side of said head, said platform being integrally coupled to said head, a plurality of bristles being coupled to and extending upwardly from said platform, a peripheral edge of said platform being spaced from a perimeter edge of said head;

a cap removably coupled to said toothbrush, said cap having a top and a perimeter wall coupled to and extending downwardly from said top, a bottom edge of said perimeter wall defining an access opening into an interior space of said cap, said perimeter wall of said cap having an octagonal shape, said cap being transparent, said perimeter wall including a first longitudinal side and a second longitudinal side positioned opposite of each other, a rear end of said cap abutting a front edge of said neck when said cap is coupled to said platform, said perimeter wall of said cap engaging said platform to couple said cap to said toothbrush, said bristles being positioned in said interior space of said cap when said cap is coupled to said toothbrush;

said perimeter wall of said cap having a plurality of indentations extending into an outer surface thereof to facilitate gripping of said cap, each of said indentations being elongated extending along said first and second longitudinal sides, said indentations on said first longitudinal side being spaced and aligned relative to each other, said indentations on said second longitudinal side being spaced and aligned relative to each other, each of said indentations extending longitudinally between a front end and said rear end of said cap, each of said indentations defining a concave depression in said outer surface of said perimeter wall;

a groove extending into said peripheral edge of said platform, said groove extending around a full perimeter of said peripheral edge; and a projection coupled to an inner surface of said cap extending into said interior space, said projection extending around a full perimeter of said perimeter wall, said projection being received in said groove for securing said cap to said platform, said projection being spaced above said bottom edge of said cap.

* * * * *